United States Patent [19]

Hanås

[11] Patent Number: 4,478,273

[45] Date of Patent: Oct. 23, 1984

[54] STIRRING METAL IN A CONTINUOUS CASTING MOLD

[75] Inventor: Bertil Hanås, Västerås, Sweden

[73] Assignee: ASEA Aktiebolag, Västerås, Sweden

[21] Appl. No.: 495,007

[22] Filed: May 18, 1983

Related U.S. Application Data

[63] Continuation of Ser. No. 226,547, Jan. 21, 1981, abandoned.

[30] Foreign Application Priority Data

Jan. 31, 1980 [SE] Sweden ..... 8000756

[51] Int. Cl.[3] ..... B22D 27/02

[52] U.S. Cl. ..... 164/468; 164/504

[58] Field of Search ..... 164/468, 499, 504, 147.1, 164/469, 470, 495, 496, 497, 508, 509

[56] References Cited

U.S. PATENT DOCUMENTS

| | | | |
|---|---|---|---|
| 2,380,109 | 7/1945 | Hopkins | 164/470 |
| 2,397,789 | 4/1946 | Hopkins | 164/470 X |
| 2,445,670 | 7/1948 | Hopkins | 164/470 X |
| 3,234,608 | 2/1966 | Peras | 164/470 |
| 3,246,373 | 4/1966 | Lyman | 164/499 |
| 3,804,147 | 4/1974 | Babel et al. | 164/504 X |
| 4,055,215 | 10/1977 | Ramacciotti et al. | 164/515 |
| 4,158,380 | 6/1979 | Sasaki et al. | 164/468 X |

FOREIGN PATENT DOCUMENTS

| | | | |
|---|---|---|---|
| 47-25967 | 7/1972 | Japan | 164/497 |
| 1272844 | 5/1972 | United Kingdom . | |
| 526443 | 8/1976 | U.S.S.R. | 164/495 |

*Primary Examiner*—Kuang Y. Lin

*Attorney, Agent, or Firm*—Kenyon & Kenyon

[57] ABSTRACT

For continuous casting with stirring of the molten metal in the mold, DC is passed lengthwise through the molten metal in the mold so as to effect the stirring.

1 Claim, 2 Drawing Figures

STIRRING METAL IN A CONTINUOUS CASTING MOLD

This application is a continuation of application Ser. No. 226,547, filed Jan. 21, 1981, now abandoned.

BACKGROUND OF THE INVENTION

To continuously cast molten metal, it is cast or fed as by continuously teeming from a ladle or tundish, into the open top of a continuous casting mold having an open bottom.

The mold is cooled and the downwardly traveling molten metal solidifies first at its surface in the mold to form a solid skin so as to produce a cast strand continuously traveling from the bottom of the mold with the skin containing remaining unsolidified molten metal. The strand ultimately solidifies throughout at a distance from the mold's bottom. It is desirable to stir the molten metal in this mold as well as in the strand's skin so that the solidification of the molten metal proceeds uniformly.

For stirring after the strand has left the mold, multiphase electromagnetic stirrers positioned beside the traveling strand can be used satisfactorily, but for stirring of the molten metal in the mold an electromagnetic stirrer must project its field through the mold and the mold must be made of non-magnetic material, and this introduces complications.

The object of the present invention is to stir the molten metal inside of the continuous casting mold during the formation of the solidified skin in the mold, in a relatively simple but effective manner.

BRIEF SUMMARY OF THE INVENTION

The above object is attained by this invention by passing direct current lengthwise through the molten metal while it travels through the continuous casting mold, thereby to cause the stirring of the molten metal in the mold.

A suitable DC power means can be connected to a first electrode centrally contacting the upper portion or level of the molten metal in the mold, and to a second electrode contacting the solid skin forming in the mold below this upper portion. The second electrode can be provided by either a metal mold itself or via a contactor in sliding contact with the strand's skin above or below, but preferably close to the mold's bottom. In the latter case, it does not matter whether or not the mold itself is electrically conductive.

The degree of DC strength or power used depends on the desired degree of stirring and may vary for molds of differing dimensions and shapes, although enough power should be used to obtain the stirring action desired.

BRIEF DESCRIPTION OF THE DRAWINGS

The principles of this invention are schematically illustrated by the accompanying drawings, in which.

DETAILED DESCRIPTION OF THE INVENTION

Figure 2:
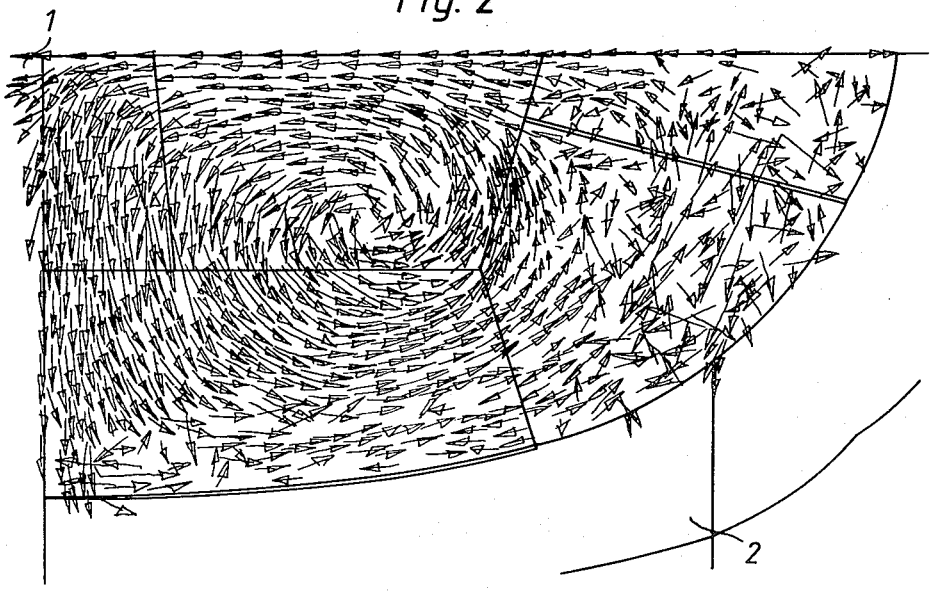
FIG. 2 is a vertical section through one half of a melt in the harth of a DC arc furnace.

To assist in understanding this invention, FIG. 2 in vertical section shows one half of a melt, such as molten steel, in the hearth of a working DC electric arc furnace using a single arcing electrode, the numeral 1 indicating the location of the foot of the arc and 2 indicating the hearth or melt contacting electrode. Although not illustrated, it is to be understood that the two electrodes are connected to a source of DC arcing power.

The current passing through the melt to the arc has been found to produce effective stirring of the melt being processed, the field vectors of this stirring being illustrated by the multitude of arrows in FIG. 2 each showing a melt flow curve. This field has been obtained in the case of a steel melt after four iterations or repetitions. 1 cm in the figure means 0.1 m/sec., and the maximum speed obtained is 0.7 m/sec. The stirring is due to the currents flowing through the melt and it follows that the action would be obtained in the case of any melt of any metal or alloy.

Figure 1:
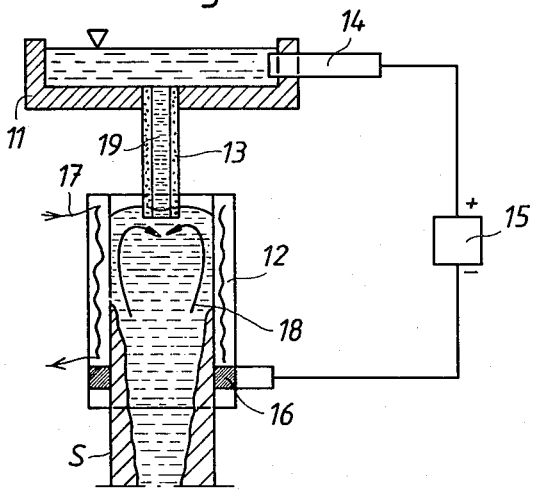
FIG. 1 is a vertical section of a continuous casting apparatus embodying the invention.

Keeping the above in mind, FIG. 1 shows a container which may be a ladle or tundish 11 containing molten metal being cast into a continuous casting mold 12 via a teeming pipe or charging tube 13 depending from the container and which may be made of metal or ceramic material. A connection 14 projects through the wall of the container 11 into contact with the molten metal in the manner of a DC arc furnace hearth or melt contact electrode and is in this instance anodically connected to a DC power source 15. As illustrated, a connection 16 is made as a part of the mold 12 positioned in the bottom part of the mold so as to be in sliding contact with the skin S of the strand forming in and traveling continuously from the bottom of the mold 12. 17 indicates water-cooling of the mold.

With adequate power of DC, the stirring action in the mold is indicated by the arrows 18. As shown, the flow of molten metal is upwardly along the periphery of the mold and extends above the level where the skin S is starting to form so that the forming skin is maintained free from slag or other undesirable formations.

It can be seen that the first electrode is, in effect, the molten metal 19 flowing down through the pipe or charging tube 13. This tube preferably has its lower end positioned below the level to which the mold fills with the molten metal and is maintained filled with the molten metal during the continuous casting. The lower or bottom end of the tube is immersed in the metal in the mold. Also, the tube 13 should be of substantially smaller cross-sectional size than that of the top of the mold 12 and preferably centrally positioned relative to this top. In the illustrated case, the current flows through the melt to the central point formed by the descending stream of molten metal 19. The second electrode is formed by the connection 16 and can be positioned for sliding contact with the skin S either within or below the bottom of the mold 12. In any event, it should be designed to avoid the possibility of arcing insofar as possible. Arcing can be completely avoided if the mold 12, when made of metal, is itself made the second electrode by being connected with the connection 16.

In the academic sense, the relatively narrow stream 19 of the molten metal acts like the arc in the case of the DC arc furnace of FIG. 2, the second electrode or contactor 19 acting like the hearth or melt connection of that furnace.

The passage of the current through the melt or molten metal in the mold 12, going to the centrally positioned relatively small electrode formed by the flow 19, produces effective stirring of the melt which while in the mold 12 is continuously moving downwardly to gradually form the skin S.

It may be desirable to use electromagnetic stirring of the molten metal in the mold 12 to obtain an additional stirring action. Because the stirring action of the present invention is predominantly within the mold itself, the usual electromagnetic stirrers may be used for the length of strand containing unsolidified metal and traveling downwardly and away from the mold 12.

What is claimed is:

1. A method for stirring molten metal while in a continuous casting mold into the top of which is cast molten metal which continuously travels downwardly while solidifying at the surface of the mold at a location below the mold's top so as to form a strand containing unsolidified metal continuously traveling from the mold's bottom; said method comprising immersing a solid metal electrode directly in the molten metal being cast into the top of said mold and slidingly contacting said strand traveling from the mold's bottom with a second solid metal electrode, and applying DC electric current to said electrodes so as to cause the unsolidified metal in the mold to stir with a vertical flow throughout the height of the mold.

* * * * *